United States Patent [19]

Kazmierowicz

[11] 3,932,312

[45] Jan. 13, 1976

[54] CONSTANT TEMPERATURE COEFFICIENT THICK FILM THERMISTOR

[75] Inventor: Casimir W. Kazmierowicz, Mission Viejo, Calif.

[73] Assignee: Beckman Instruments, Inc., Fullerton, Calif.

[22] Filed: Apr. 1, 1974

[21] Appl. No.: 456,792

[52] U.S. Cl. ..... 252/518; 106/47 R; 106/54; 252/520; 252/521; 338/22 R; 428/426; 428/428

[51] Int. Cl.² ..... H01B 1/08

[58] Field of Search ..... 252/518; 106/47 R, 54; 428/426, 428

[56] References Cited

FOREIGN PATENTS OR APPLICATIONS 1,328,954 9/1973 United Kingdom

*Primary Examiner*—Leland A. Sebastian
*Assistant Examiner*—E. Suzanne Parr
*Attorney, Agent, or Firm*—R. J. Steinmeyer; J. M. McCormack

[57] ABSTRACT

A thermistor material which, when screened and fired upon ceramic substrates by thick film techniques, exhibits a substantially constant temperature coefficient of electrical resistance. The thermistor composition or ink, before screening, comprises from 30 to 80% by weight of an oxide of vanadium $VO_X$, where X varies from 1.5 to 2.5, mixed with 70 to 20% by weight of a glass frit.

10 Claims, 1 Drawing Figure

RESISTANCE RATIO VS TEMPERATURE

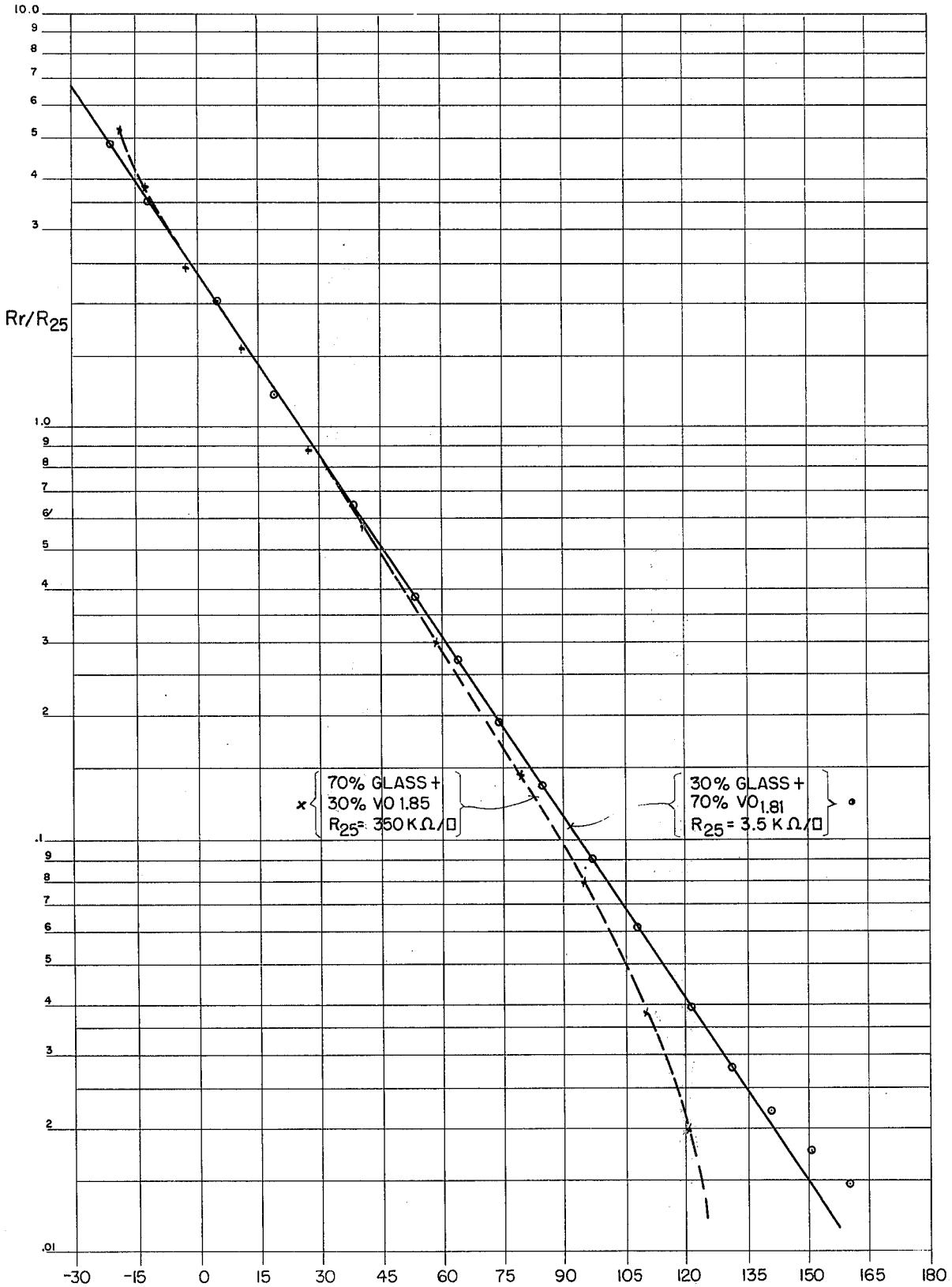
RESISTANCE RATIO VS TEMPERATURE

CONSTANT TEMPERATURE COEFFICIENT THICK FILM THERMISTOR

BACKGROUND OF THE INVENTION

The present invention relates to a method of producing a thermistor material or ink which, when screened and fired on ceramic substrates by thick film techniques, exhibits a substantially constant temperature coefficient of electrical resistance. Heretofore in the prior art, most negative temperature coefficient thermistors have exhibited temperature coefficient of resistance (TCR) values which vary depending upon the temperature at which they are measured.

The TCR for any resistor is defined by the following expression:

$$\alpha = \frac{1}{R(T)} \frac{dR(T)}{dT} \quad (1)$$

where $\alpha$ is the TCR usually expressed in percent per degree centigrade, and $R_T$ is the functional relationship of the sheet resistance upon temperature. If $\alpha$ is to be constant within the temperature interval $T-T_0$ and $R_T$ and $R_{T_0}$ are the resistance values at the respective temperatures, then by integration equation (1) yields:

$$\ln R_T/R_{T_0} = \alpha(T-T_0). \quad (2)$$

Further reduction yields:

$$R_T = R_{T_0} e^{\alpha (T-T_0)}, \quad (3)$$

which is the final expression relating resistance to the temperature if the TCR is constant. The resistivities of most thermistor materials vary with temperature according to the following expression:

$$R_T = R_{T_0} e^{\beta \left(\frac{1}{T} - \frac{1}{T_0}\right)}, \quad (4)$$

where both $R_{T_0}$ and $\beta$ are constant independent of temperature. Using equation (1) it can be shown that for these materials the TCR depends upon temperature according to the following expression:

$$\alpha \simeq -\frac{\beta}{T^2} \quad (5)$$

OBJECTS OF THE INVENTION

Accordingly, it is an object of the invention to provide a thermistor ink with a TCR value that is substantially constant over a wide temperature range.

It is another object of the invention to provide a thermistor ink with a TCR value in excess of 3.0% per degree centigrade, where the TCR value is substantially constant over temperatures ranging from +10°C to +90°C.

BRIEF DESCRIPTION OF THE DRAWINGS

FIG. 1 is a plot of resistance ratio vs. temperature for two thermistor compositions according to the present invention.

DETAILED DESCRIPTION OF THE INVENTION

The thermistor ink compositions of the invention generally comprise 30 -80% by weight of oxide of vanadium $VO_X$ where X in the starting composition may vary from 1.5 to 2.5, along with 70 -20% by weight of a glass frit. In the preferred embodiment, the value of X in the starting composition may vary from 1.6 to 1.9.

The TCR values of thermistor inks are substantially constant within varying temperature intervals depending upon the value of X utilized in the above composition. Also, the magnitude of the TCR and the sheet resistivity of the material are dependent on the value of X utilized. Several different glass frits of the aluminoborosilicate class have been utilized successfully in the above composition. One frit with the following composition by weight:

| | | |
|---|---|---|
| $Al_2O_3$ | — | 4.1% |
| $B_2O_3$ | — | 15.4% |
| $SiO_2$ | — | 52.3% |
| $ZrO_2$ | — | 1.2% |
| SrO | — | 17.3% |
| CaO | — | 5.4% |
| $Na_2O$ | — | 4.3% |

was particularly useful over a wide temperature range.

It should be apparent that the value of X yielding desired TCR properties will depend upon the method utilized to synthesize the $VO_X$, the nature and amount of the glass frit utilized since it may affect the reduction of vanadium oxide, the composition of the substrate utilized since it also may affect the reduction of the vanadium oxide, and the time, temperature and atmosphere of film firing.

In formulating the thermistor inks in accordance with the invention, the oxide $VO_X$ was prepared in certain instances by controlled reduction of $V_2O_5$ in reducing atmosphere, such as $H_2$, at temperatures of 500°–700°C. Under these conditions the $V_2O_5$ would reduce completely to the stable phase $V_2O_3$, provided sufficient time were allowed. However, if the time is controlled, a desired intermediate oxide phase results. In conjunction with this method of preparation of vanadium oxide, the glass frit may be mixed with the $V_2O_5$ prior to reduction or mixed with the reduced oxide product.

Another method of preparation of the vanadium oxide consists of oxidizing the lower oxide $V_2O_3$ in oxidizing atmospheres such as oxygen or carbon dioxide. Again, the oxidizing time or temperature may be controlled as well as the oxidizing gas partial pressure to develop a $VO_X$ with the desired value of X.

Still another method of preparing the $VO_X$ consists of calcining mixtures of $V_2O_3$ and $V_2O_5$ in desired proportions in neutral or inert atmospheres such as nitrogen or argon. The calcining time and temperature again are controlled, but are not as critical as in the above described methods. The temperature is typically maintained at around 1100°–1300°C for times on the order of one to three hours. Since the glass frits utilized in conjunction with the vanadium oxide generally soften well below these calcining temperatures, the glass frit is preferably added after the desired oxide is prepared.

Regardless of the method of preparing the oxide, a mixture of oxide and glass frit is generally ball milled for three to sixteen hours in preparation. The powder thus obtained is subsequently mixed with an appropriate binder (many of which are well known in the art) to impart the proper rheology to the material for thick film printing.

After preparation, the ink can be screened onto any suitable insulating material, such as alumina or steatite, which can withstand the neutral or inert atmosphere firing at 1000°–1100°C for five to twenty minutes. Appropriate termination materials can be screened and fired either over or beneath the thermistor ink to provide the desired electrical contacts thereto.

Following are specific examples of the preparation of thermistor inks according to the invention:

EXAMPLE 1

In a typical example 32.9 gms. of $V_2O_3$ was intimately mixed with 17.1 gms. of $V_2O_5$ in a ball mill jar for four hours. Fifty ml. of methanol were used as the milling fluid. This mixture was then dried in an oven at 100°C until all of the methanol was evaporated. The dry mix was then screened through a 40-mesh screen and loaded into an Inconel boat. The boat was placed in the cool end of a 2.5 inch diameter tube furnace which had nitrogen flowing through it at the rate of 50 cubic feet per hour for at least 15 minutes, during which time the furnace was stabilized at 650°C. The boat was then pushed directly into the hot zone and left at 650°C for one hour. After one hour the furnace controller was raised to 1250°C and held at this setting for two hours. The boat was then pulled directly from the hot zone into the cool zone and allowed to cool in nitrogen for at least thirty minutes. When cool, the material was removed from the furnace and screened through a 40-mesh screen. Its color at this point was black to dark blue.

The above material was subsequently mixed with glass by weighing out 40 gms. with 10 gms. of glass frit and depositing these materials in a ball mill jar along with 50 ml. of methanol. This mixture was then rolled for four hours, dried, and screened through a 325-mesh screen. This powder was then mixed with an appropriate organic binder to yield the proper viscosity for screen printing, put into a glass jar and placed on a thick film roller for storage.

The above paste was then screen-printed through a 200-mesh screen onto a steatite substrate. The substrates were fired in a controlled atmosphere belt kiln at 1100°C for fifteen minutes in a nitrogen atmosphere. The resistors made in this way had the properties indicated in Example 1 of Table 1.

X-ray diffraction patterns of the fired films revealed the presence of mixtures of the two conducting oxides of vanadium, $V_2O_3$ and $V_2O_5$.

EXAMPLE 2

In another example, 180 gms. of $V_2O_3$ was mixed with 120 gms. of $V_2O_5$ in a ball mill jar along with 300 mls. of methanol for four hours. The dried and screened material was placed in an Inconel boat and fired in a tube furnace as in the first example, except that argon gas was used instead of nitrogen. The charge was allowed to remain at 650°C for one hour and then pulled out of the hot zone one hour after the temperature controller was reset to 1250°C. When cool, the material was removed from the furnace and screened through a 40-mesh screen. This powder had a somewhat lighter blue color than the one in the previous example.

Fifteen gms. of this material was mixed in a ball mill jar along with 35 gms. of glass frit and 50 mls. of methanol for four hours. As above, the dried powder was made into a thick film paste and stored in a glass jar on a roller.

Screen printed resistors of this material which were fired in a nitrogen atmosphere for fifteen minutes at 1000°C have the properties indicated in Example 5 of Table I.

Table I below illustrates the variation in X required to obtain maxima in TCR for various other glass-to-oxide compositions deposited upon steatite and alumina.

Table I

| Example No. | $VO_X$ Wt.% | Glass Wt.% | X | $V_2O_3$ Wt.% | $V_2O_5$ Wt.% | Substrate Material | R25°C Ω/Square | TCR %/°C |
|---|---|---|---|---|---|---|---|---|
| 1 | 80 | 20 | 1.800 | 65.8 | 34.2 | Steatite | 1.1K | 3.43 |
| 2 | 80 | 20 | 1.783 | 67.7 | 32.3 | Alumina | 2.5K | 3.61 |
| 3 | 70 | 30 | 1.845 | 60.8 | 39.2 | Steatite | 4K | 3.42 |
| 4 | 70 | 30 | 1.810 | 64.7 | 35.3 | Alumina | 3.5K | 3.39 |
| 5 | 30 | 70 | 1.850 | 60.0 | 40.0 | Alumina | 350K | 3.66 |

The sheet resistivity and TCR values of typical series of compositions according to the invention can be plotted against the variable X. In such plots the resistivity and TCR values have been found to peak quite sharply at X values of 1.78 to 1.81 in the starting composition, depending upon whether the composition is deposited upon steatite or alumina. When analyzed in the fired state the X value for peak resistivity has been found to be about 1.6. The peak value of sheet resistivity for a 20% glass frit and 80% $VO_X$ composition formulated according to the invention was found to be 2.5K ohms per square at 25°C, whereas the value of TCR in percent per degree centigrade was approximately 3.6 when deposited upon alumina.

The values of X are of further significance since, in addition to maxima in $R_T$ and TCR, the most constant TCR values with temperature are also observed at or near these values.

The degree to which the TCR for a given composition is constant over a given temperature range is best illustrated by the curves in FIG. 1. In FIG. 1, the log of the resistance ratio $R_T/R_{25}$ is plotted against temperature. According to equation (2) it is apparent that the TCR or $\alpha$ will be constant as long as a straight line relationship is maintained between the log $R_T/R_{T_0}$ and T. FIG. 1 illustrates that a 30% glass-70% $VO_{1.81}$ material exhibited a constant TCR between approximately −15°C and 125°C. and a 70% glass-30% $VO_{1.85}$ material exhibited a constant TCR between +10°C and +90°C. The value of $\alpha$ obtained by using equation (2) was 3.39% per degree centigrade for the 30% glass mixture and 3.66% per degree centigrade for the 70% glass mixture, illustrated in the graph over the ranges of constant TCR. By way of contrast, most conventional thermistor materials would exhibit TCR values which vary from 5.5% per degree centigrade to 2.5% per degree centigrade in the same temperature ranges.

It should be apparent that the improved thermistor ink of the present invention has utility in the fabrication of constant temperature coefficient thermistors which can be utilized in a variety of electrical circuits. For example, thermistors fabricated in accordance with the invention could be employed as constant voltage or constant current regulating devices or employed in conjunction with amplifiers for the same purpose.

We claim:

1. A thermistor material composition comprising 30–80% by weight $VO_X$ where X varies from 1.5 to 1.9, and 70–20% by weight of glass.

2. The composition of claim 1 where the glass is of the alumino-borosilicate class.

3. The composition of claim 1 where X varies from 1.6 to 1.9.

4. A thermistor material having a substantially constant temperature coefficient of resistance over the range of 10°C to 90°C comprising 30–80% by weight $VO_X$, where X varies from 1.5 to 1.9 and 70–20% by weight of glass.

5. The composition of claim 4 wherein the glass is of the alumino-borosilicate class.

6. The composition of claim 4 where X varies from 1.6 to 1.9.

7. A method of making a thermistor having a substantially constant temperature coefficient of resistance over the range of 10°C to 90°C comprising preparing a thermistor material composition comprising 30–80% by weight $VO_X$ where X varies from 1.5 to 1.9 and 70–20% by weight of glass, applying and firing said composition to a ceramic substrate to form a thermistor.

8. The method of claim 7 where the applying said composition is accomplished by screening.

9. The method of claim 7 where the glass is of the alumino-borosilicate class.

10. The method of claim 7 where X varies from 1.6 to 1.9.

* * * * *